US010813404B2

(12) United States Patent
Orza

(10) Patent No.: US 10,813,404 B2
(45) Date of Patent: Oct. 27, 2020

(54) SHOCK-ABSORBING DANCE SHOE ASSEMBLY

(71) Applicant: Orzapro LLC, Seattle, WA (US)

(72) Inventor: Seth Orza, Seattle, WA (US)

(73) Assignee: ORZAPRO LLC, Seattle, WA (US)

( * ) Notice: Subject to any disclaimer, the term of this patent is extended or adjusted under 35 U.S.C. 154(b) by 187 days.

(21) Appl. No.: 14/324,793

(22) Filed: Jul. 7, 2014

(65) Prior Publication Data

US 2015/0007457 A1 Jan. 8, 2015

Related U.S. Application Data

(60) Provisional application No. 61/843,844, filed on Jul. 8, 2013.

(51) Int. Cl.

| | |
|---|---|
| ***A43B 5/12*** | (2006.01) |
| ***A43B 7/14*** | (2006.01) |
| ***A43B 13/18*** | (2006.01) |
| ***A43B 13/26*** | (2006.01) |

(52) U.S. Cl.

CPC ..... *A43B 5/12* (2013.01); *A43B 7/144* (2013.01); *A43B 7/148* (2013.01); *A43B 7/149* (2013.01); *A43B 7/1425* (2013.01); *A43B 7/1445* (2013.01); *A43B 13/188* (2013.01); *A43B 13/26* (2013.01)

(58) Field of Classification Search

CPC ..... A43B 5/12; A43B 7/1425; A43B 7/144; A43B 7/1445; A43B 7/148; A43B 7/149; A43B 13/188; A43B 13/26

USPC ..... 36/102, 35 R, 8.3, 28, 43, 68, 69, 58.5, 36/58.6, 92

See application file for complete search history.

(56) References Cited

U.S. PATENT DOCUMENTS

| | | | | | |
|---|---|---|---|---|---|
| 1,889,275 | A | * | 11/1932 | Domahoski | A43B 5/12 36/113 |
| 2,438,280 | A | * | 3/1948 | Gailey | A43B 23/28 2/61 |
| 2,582,910 | A | * | 1/1952 | Lyon | A43B 3/02 36/109 |
| 4,583,304 | A | * | 4/1986 | Spalding | A43B 5/12 36/113 |
| 4,783,910 | A | * | 11/1988 | Boys, II | A43B 7/14 36/107 |
| 5,111,597 | A | * | 5/1992 | Hansen | A43B 5/12 36/113 |
| 5,191,726 | A | * | 3/1993 | Vallee | A43B 5/12 36/113 |
| 5,220,735 | A | * | 6/1993 | Raoul-Duval | A43B 5/12 36/108 |

(Continued)

FOREIGN PATENT DOCUMENTS

| | | |
|---|---|---|
| WO | WO-1999051117 A2 | 10/1999 |
| WO | WO-2004107895 A1 | 12/2004 |

*Primary Examiner* — Clinton T Ostrup
*Assistant Examiner* — Cameron A Carter
(74) *Attorney, Agent, or Firm* — Fortem IP LLP; Mary Fox

(57) ABSTRACT

Low-profile dance shoes and associated methods of manufacture are disclosed herein. One aspect of the invention is directed toward a dance shoe that includes an integrated heel member that provides increased support, stability, and shock-absorption for the dancer. The dance shoe can further include a support member configured to provide lateral support to the foot and/or ankle, and a shock-absorption member.

7 Claims, 5 Drawing Sheets

(56) References Cited

U.S. PATENT DOCUMENTS 5,604,998 A * 2/1997 Kita ..... A43B 23/086 36/69
6,059,744 A * 5/2000 Hardt ..... A61F 13/066 602/27
6,125,557 A * 10/2000 Brown ..... A43B 7/14 36/144
6,519,876 B1 * 2/2003 Geer ..... A43B 1/0081 36/102
6,895,694 B2 * 5/2005 Nye ..... A43B 23/08 36/8.3
7,124,518 B1 * 10/2006 Brown ..... A43B 7/14 36/25 R
7,673,396 B2 * 3/2010 Terlizzi ..... A43B 5/12 36/8.3
7,856,739 B2 * 12/2010 Terlizzi ..... A43B 5/12 36/8.3
7,966,747 B2 * 6/2011 Wilkenfeld ..... A43B 3/06 36/102
8,448,350 B2 * 5/2013 Nataadiningrat ..... A43B 5/12 36/8.3
9,414,639 B2 * 8/2016 Heathcote ..... A43B 5/12
2002/0007568 A1 * 1/2002 Kellerman ..... A43B 7/1465 36/28
2002/0144433 A1 * 10/2002 Dennis ..... A43B 7/081 36/44
2003/0029055 A1 * 2/2003 Morrone ..... A43B 13/00 36/8.3
2003/0070319 A1 * 4/2003 Minden ..... A43B 3/108 36/8.3
2003/0121176 A1 * 7/2003 Baruck ..... A43B 5/12 36/8.3
2004/0103561 A1 * 6/2004 Campbell ..... A43B 7/141 36/88
2007/0151124 A1 * 7/2007 Chan ..... A43B 7/144 36/35 R
2007/0199208 A1 * 8/2007 Wilkenfeld ..... A43B 7/28 36/8.3
2008/0034613 A1 * 2/2008 Wilkenfeld ..... A43B 3/06 36/8.3
2008/0072461 A1 * 3/2008 Howlett ..... A43B 7/142 36/145
2008/0086912 A1 * 4/2008 Wilkenfeld ..... A43B 13/16 36/92
2009/0188131 A1 * 7/2009 Doerer ..... A43B 7/1425 36/88
2010/0186255 A1 * 7/2010 Avar ..... A43B 3/0036 36/10
2011/0209360 A1 * 9/2011 Baker ..... A43B 7/1435 36/44

* cited by examiner

SHOCK-ABSORBING DANCE SHOE ASSEMBLY

CROSS-REFERENCE TO RELATED APPLICATIONS

This application claims the benefit of U.S. Provisional Application No. 61/843,844, filed Jul. 8, 2013, the entirety of which is incorporated herein by reference.

TECHNICAL FIELD

Embodiments of the present disclosure relate to dance shoes.

BACKGROUND

Athletic shoes of all types are subject to great amounts of stress through repeated, cyclical loading caused by walking, running, and other activities. Dance shoes, however, are subject to unique stress combinations due to the repetitive, high impact levels associated with dancing. Male ballet dancers in particular experience an incredible amount of high impact loads since a male ballet dancer's routine involves a disproportionate amount of jumping on a hard surface which can be taxing on the dancer's body.

Many conventional dance shoes generally sacrifice support and/or shock absorption to provide a low-weight, low-profile shoe. For example, conventional dance shoes are made of a thin piece of cloth with little or no absorptive potential. Accordingly, current dance shoe materials generally cannot provide a range of response characteristics to different levels of pressure and impact. Conventional dance shoes may be aesthetically pleasing but are not properly calibrated for higher-impact levels. Although a stiffer, thicker shoe or insert may provide proper resiliency and performance for running or other high-energy activities, such a heavy (relatively), large-profile shoe is generally not well suited for ballet dancing (e.g., does not accentuate the contour and aesthetics of the foot, cumbersome, not-flexible enough, etc.). Accordingly, there is a need for a dance shoe assembly that can meet the needs of repetitious, high-intensity activities, such as jumping, without sacrificing comfort or performance.

DETAILED DESCRIPTION

Aspects of the present disclosure are directed generally toward dance shoes. As disclosed herein, a dance shoe, such as a ballet shoe, can include a flexible shoe body having a forefoot portion, a heel portion opposite the forefoot portion, and a midfoot portion between the heel portion and the forefoot portion. The dance shoe further includes an integrated heel member securely attached to the heel portion of the flexibly shoe body. The heel member includes a support member configured to receive a shock-absorbing member, and a top portion of the shock-absorbing member is softer than a bottom portion of the shock-absorbing member.

Various embodiments of the disclosure will now be described. The following description provides specific details for a thorough understanding and enabling description of these embodiments. One skilled in the art will understand, however, that the disclosure may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the disclosure. Certain terms may even be emphasized below; however, any terminology intended to be interpreted in any restricted manner will be overtly and specifically defined as such in this Detailed Description section.

References throughout the specification to "one embodiment" or "an embodiment" means that a particular feature, structure, or characteristic described in connection with the embodiment and included in at least one embodiment of the present disclosure. Thus, the appearances of the phrase "in one embodiment" or "in an embodiment" in various places throughout the specification are not necessarily all referring to the same embodiment. Furthermore, the particular features, structures, or characteristics may be combined in any suitable manner in one or more embodiments.

Figure 1A:
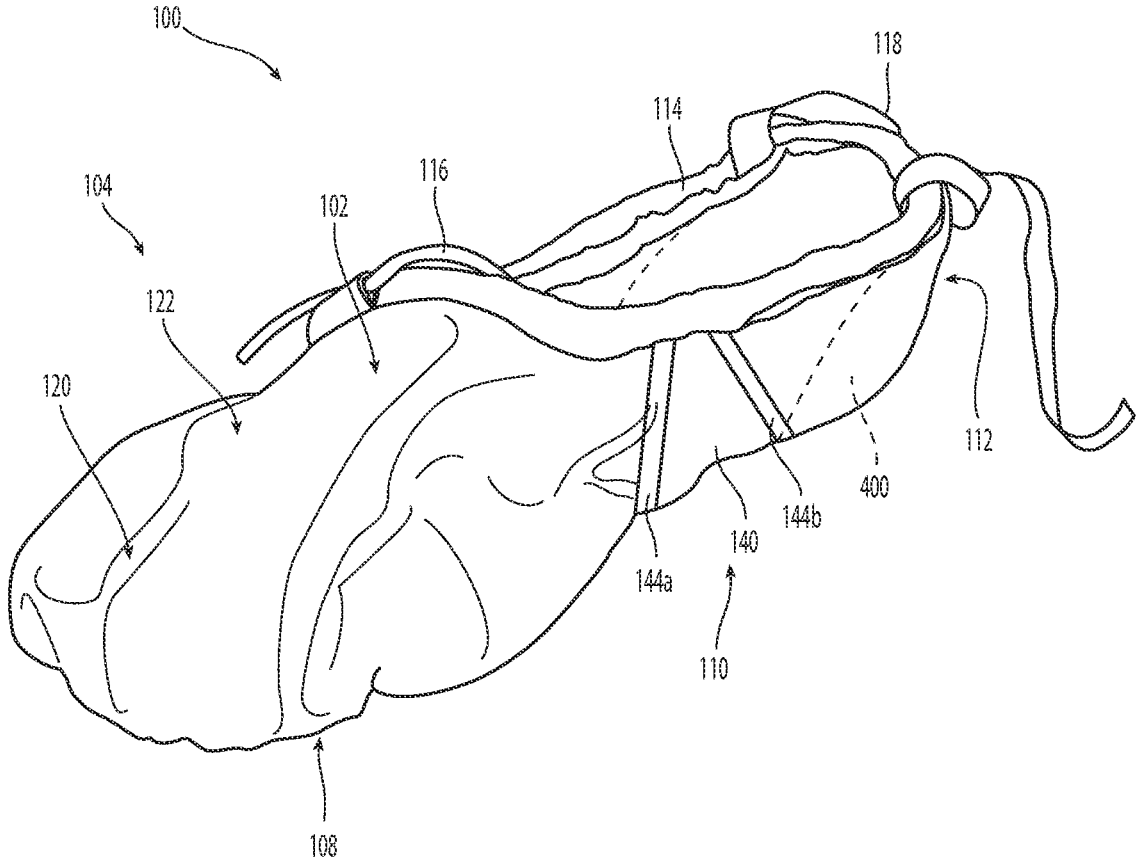
FIG. 1A is an isometric elevation view of a dance shoe configured in accordance with embodiments of the present technology.
Figure 1B:
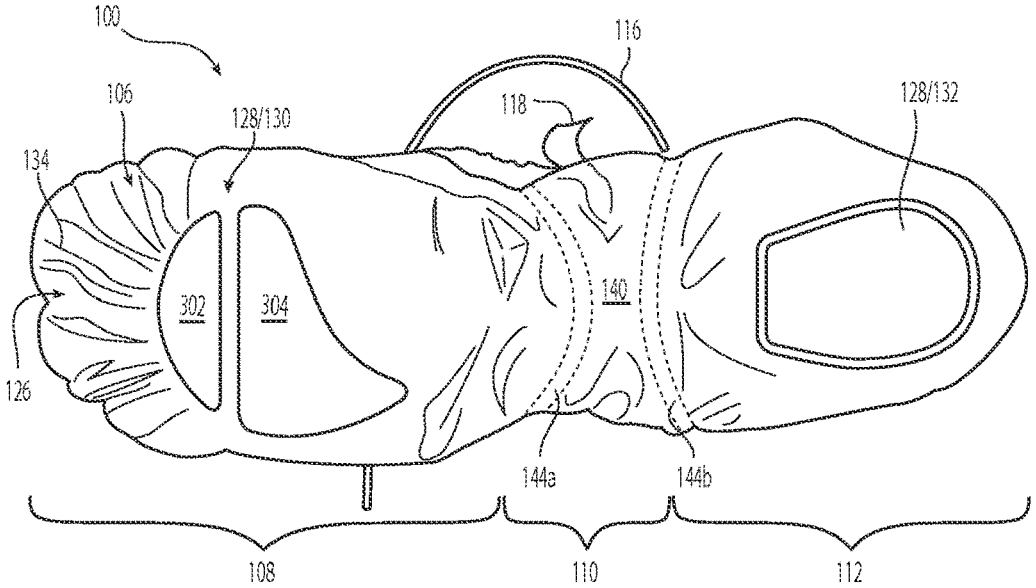
FIG. 1B is a bottom view of the dance shoe of FIG. 1A configured in accordance with embodiments of the present technology.
Figure 1C:
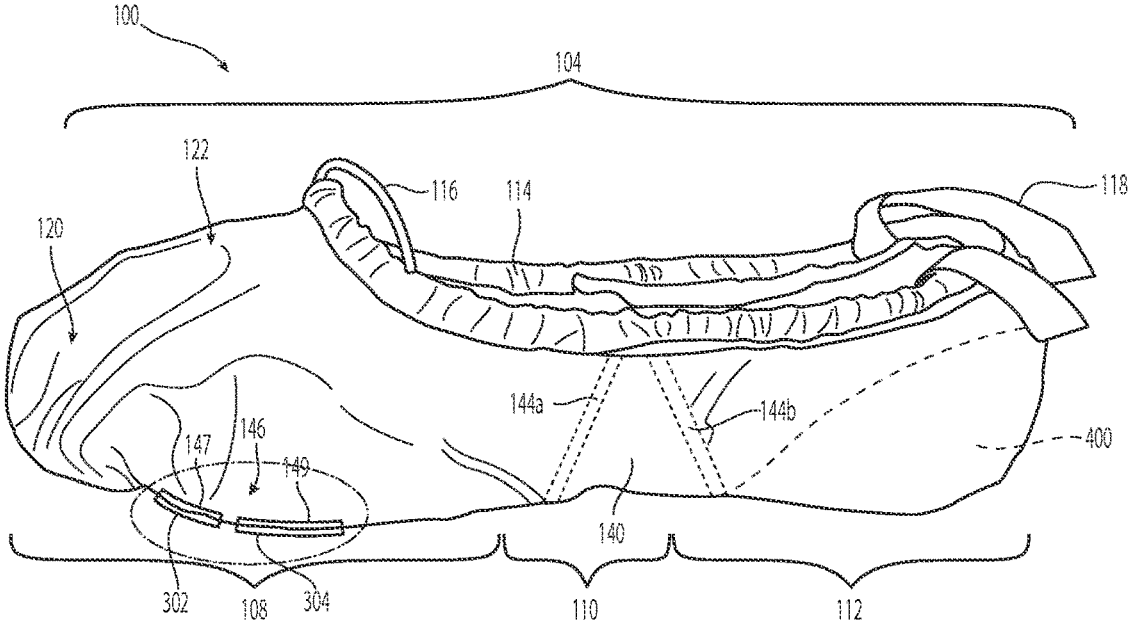
FIG. 1C is a side elevation view of the dance shoe of FIG. 1A configured in accordance with embodiments of the present technology.

FIG. 1A is an isometric view of a dance shoe 100 configured in accordance with various embodiments of the present technology. FIGS. 1B and 1C are bottom and side views, respectively, of the dance shoe 100 shown in FIG. 1A. Referring to FIGS. 1A-1C together, the dance shoe 100 includes a flexible shoe body 102 that wraps fully underneath the foot. The flexible shoe body has a top portion 104 (FIGS. 1A and 1C) and a bottom portion 106 (FIG. 1B). The flexible shoe body 102 can be made of canvas, leather, nylon, cotton and/or other suitable materials. In some embodiments the flexible shoe body 102 can be made of a single piece of material, and in other embodiments the flexible shoe body 102 can be made of multiple pieces of the same or different materials sewn together. Additionally, in some embodiments the flexible shoe body 102 can be a single layer of material, and in other embodiments the flexible shoe body 102 can include two or more layers of material. For example, in some embodiments the flexible shoe body 102 can comprise an outer layer and an inner layer. The outer layer can define the exterior surface of the dance shoe 100 while the inner layer defines the inner surface of the dance shoe 100 that contacts the dancer's foot. In some embodiments, the flexible shoe body 102 can have one or more portions having two or more layers and one or more portions having a single layer.

The flexible shoe body 102 further includes a forefoot portion 108 towards the front of the dance shoe 100, a heel portion 112 towards the rear of the dance shoe 100, and a midfoot portion 110 in between. In some embodiments, the midfoot portion 110 can include a midfoot section 140 defined by a single piece of material separate from the piece of material comprising the rest of the flexible shoe body 102. The flexible shoe body 102 can connect to the midfoot section 140 by a first seam 144*a* and a second seam 144*b*. The midfoot section 140 allows greater flexibility of the dance shoe 100 between the forefoot portion 108 and the heel portion 112, especially throughout the midfoot portion 110.

Referring still to FIG. 1A, the top portion 104 of the flexible shoe body 102 can include a circular sleeve 114 that defines an opening in the flexible shoe body 102 through which the foot is received. One or more drawstrings, elastic cords, and/or other suitable fastening devices 116 may pass through the sleeve 114 to secure the dance shoe 100 to the dancer's foot. In some embodiments, the dance shoe 100 can additionally or alternatively include one or more elastic straps 118 (shown in FIG. 1A in a relaxed position) fixedly attached to the flexible shoe body 102 and configured to engage a dancer's leg, ankle and/or foot. At least a portion of the circular sleeve 114 can include padding, such as at the front and/or rear surface of the sleeve 114, to provide increased comfort between the portion of the dancer's leg, ankle and/or foot that is in contact with the flexible shoe body 102 at the sleeve 114.

As best shown in FIGS. 1A and 1C, the forefoot portion 108 of the flexible shoe body 102 includes a toe portion 120 that encases the dancer's toes and a vamp portion 122 that extends rearwardly from a top region of the toe portion 120 to a front edge of the circular sleeve 114. As best shown in FIG. 1B, the toe portion 120 includes a bottom region 126 disposed below the toes of the dancer. The flexible shoe body 102 can have one or more pleats 134 at the bottom region 126 of the toe portion 120. Pleats provide the advantage of additional flexibility, which is especially important in the forefoot portion 108.

The dance shoe 100 may further include one or more flexible traction pads 128 disposed at the bottom portion 106 of the flexible shoe body 102 to provide additional support and/or cushioning to the dancer's foot, especially at high-intensity impact points (e.g., the ball and heel of the foot). The traction pad(s) 128 may individually comprise one or more layers. The traction pad(s) 128 and/or traction pad layer(s) may be stitched, glued or otherwise attached to a bottom surface of the flexible shoe body 102. To provide better traction for the dancer, the traction pad(s) 128 can be textured with one or more grooves and/or protrusions along a bottom surface of the traction pad(s). The traction pad(s) 128 can be made of canvas, leather, rubber, neoprene and/or any other material that increases frictional forces between the traction pad(s) 128 and the ground.

In the illustrated embodiments, the dance shoe 100 has a front traction pad 130 and a rear traction pad 132 such that the midfoot portion 110 of the dance shoe 100 is defined by the more flexible material of the flexible shoe body 102. Having separate front and rear traction pads 130, 132 allows the dance shoe 100 to flex at the midfoot portion so as to facilitate maintaining close proximity between a bottom region of the midfoot portion 110 and the dancer's foot, particularly when the foot is flexed. In other embodiments, the dance shoe 100 may have only a front traction pad 130, only a rear traction pad 132, or in some embodiments, the dance shoe 100 may not include any traction pads. The front traction pad 130 and rear traction pad 132 can be the same or different shapes. The front and rear traction pads 130, 132 can also provide increased cushioning and/or shock-absorption for the dancer by selected traction pad thickness, layering, and/or material composition. For example, the rear traction pad 132 can have a thickness of generally between about 1 mm and 4 mm (e.g., about 2 mm, about 3 mm), while the front traction pad 130 can generally have a thickness less than 1 mm. As such, when the dance shoe 100 is on the dancer's foot but not under the weight of the dancer, the bottom layer of the dance shoe 100 (e.g., the bottom portion of the flexible shoe body 102 and/or the traction pad 128) has a thickness of less than or equal to 4 mm (e.g., less than 3 mm, less than 2 mm, 0.5 mm, etc.).

Figure 2A:
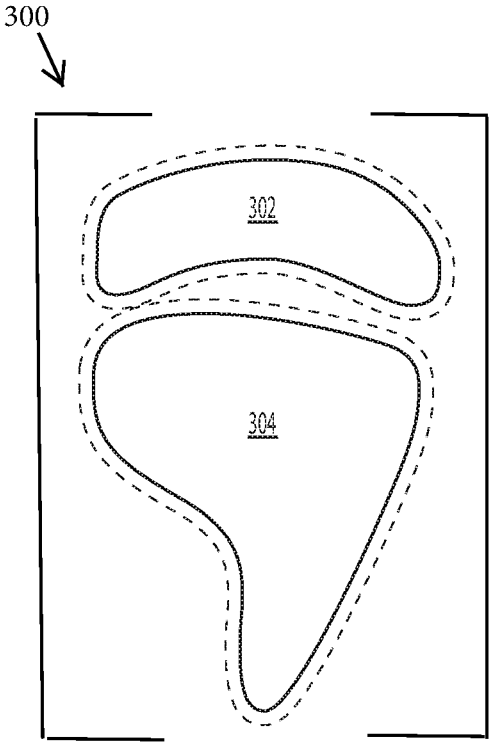
FIGS. 2A-2C are schematic illustrations of various embodiments of a split front traction pad configured in accordance with the present technology.
Figure 2B:
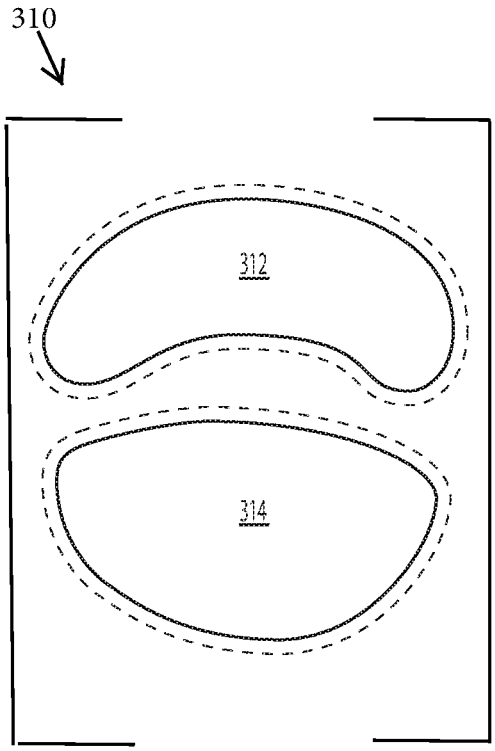
Figure 2C:
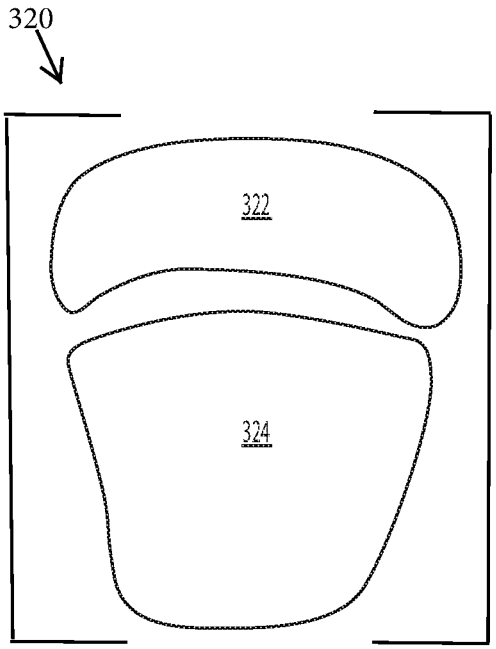

FIGS. 2A-2C illustrate various embodiments of a front traction pad 130 having a split design (e.g., at least two separate and distinct traction pads at the forefoot). A split design at the front traction pad 130 is configured to define a flex groove between two spaced apart sole portions that allows greater flexibility along the ball of the foot during use without sacrificing the support and cushioning provided by a traction pad. Also, the split design facilitates bending of the traction pad so that the traction pad and/or dance shoe remains in close proximity to and follows the contours of the dancer's foot. In particular, the split front traction pad allows the dancer's toes to grab the front of the dance shoe 100 during a toe point and bend the front traction pad to match the curvature of the foot. Because of the thin profile of the dance shoe 100, an observer can aesthetically appreciate the line created by the dancer's leg and bent foot. Such aesthetic requirements are not considered in the design and/or manufacture of conventional athletic shoes.

FIG. 2A shows one embodiment of a split front traction pad 300 that has a curved, "jelly-bean" shaped front section 302 and a rear section 304. The front section 302 can be positioned along the forefoot portion 108 such that, when worn, the front section 302 aligns with the dancer's toes. The rear section 304 can be spaced apart from the front section 302 and positioned along the forefoot portion 108, such that, when worn, the rear section 304 aligns with the ball of the dancer's foot and at least a portion of the dancer's midfoot. The rear section 304 can have a curved, tear-drop shape that narrows toward a rear portion of the dance shoe 100. FIG. 2B shows another embodiment of split front traction pad 310. The front section 312 of the embodiment shown in FIG. 2B is generally similar to the front section 302 shown in FIG. 2A. However, the front traction pad 310 of FIG. 2B has a more circular rear section 314 that is positioned to align more precisely with the ball of the dancer's foot without having additional material extending toward the midfoot. FIG. 2C shows yet another embodiment of a split front traction pad 320. The front section 322 of the embodiment shown in FIG. 2C is generally similar to the front section 302 shown in FIG. 2A. However, the rear section 324 of the embodiment shown in FIG. 2C has more of a generally square shape and is configured to cover the ball of the dancer's foot, as well as a front portion of the dancer's midfoot. As shown in FIGS. 2A-2C, the front and/or rear sections can have a generally rounded contour so that the edges of the sections are not uncomfortable for the dancer when the dance shoe 100 is bent around the midfoot portion 110.

Figure 1D:
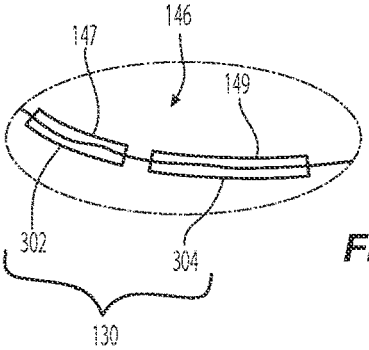
FIG. 1D is a cross-sectional view of a portion of a front sole of the dance shoe of FIG. 1A configured in accordance with embodiments of the present technology.

Referring back to the side cross-sectional view of FIG. 1D, the bottom portion 106 of the illustrated dance shoe 100 includes one or more internal metatarsal pads 146 on the interior of the dance shoe 100 that are aligned with one or more of the front traction pads 130. In the embodiment shown in FIG. 1D, the metatarsal pad 146 is a split-pad design that includes a front pad 147 and a rear pad 149 that are aligned with the front section 302 and rear section 304, respectively, of the front traction pads 130 such that a portion of the bottom portion 106 of the flexible shoe body 102 is sandwiched between the front and/or rear sections 302, 304 of the front traction pad 130 and the front and/or rear metatarsal pads 147, 179. In other embodiments, the metatarsal pad 146 can comprise a single pad regardless of the configuration of the traction pad 128. For example, in such embodiments, the metatarsal pad 146 can be aligned with the first traction pad, the second traction pad, and/or cover both the first and second traction pads. The metatarsal pads 146 are not visible while the dancer is wearing the dance shoes and are configured to provide an additional layer of cushioning and support within the shoe, under the metatarsal region of the foot, while the dance shoe maintains a sleek, contoured, fitted external profile on the dancer's foot. The metatarsal pads 146 can be made of foam, neoprene or other suitable shock-absorbing materials. In some embodiments, the metatarsal pads 146 can be stacked on or fixedly attached to one or more of the front traction pad(s) 130. In such embodiments, the bottom portion 106 of the flexible shoe body 102 can have a hole, and the flexible shoe body 102 is stitched around the periphery of the stacked front traction pad(s) 130 and metatarsal pads 146.

Figure 3A:
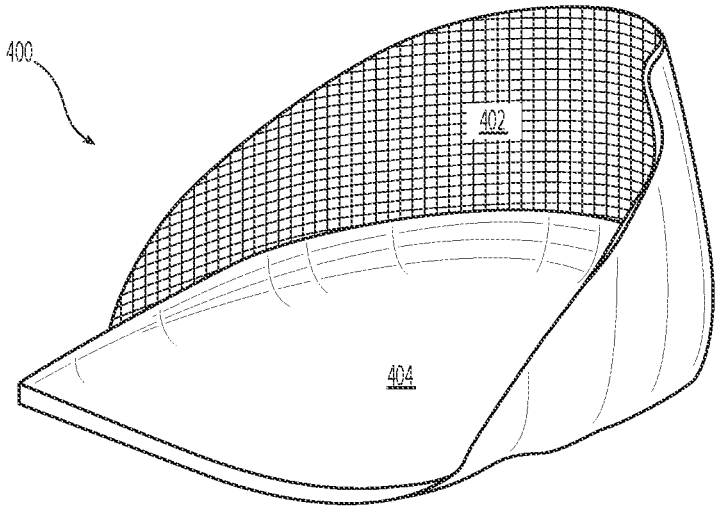
FIG. 3A is an isometric elevation view of the heel member of the dance shoe shown in FIGS. 1A-1D configured in accordance with the present technology.

FIG. 3A is an isolated, isometric elevation view of a heel member 400 configured in accordance with the present technology. The heel member 400 generally has a "cupped" shape and is fixedly attached at the heel portion 112 of the dance shoe 100 to define a close fitting heel cup that receives and engages the heel of the dancer's foot. The heel member 400 is fixedly attached to the flexible shoe body 102 and/or one or more layers of the flexible shoe body 102 via stitching, adhesive, or other suitable fixation methods and/or devices. In another embodiment, the heel member 400 may be removable from the dance shoe 100. The heel member 400 may define an inner surface of the shoe at the heel portion 112, or in some embodiments, the heel member 400 can be sandwiched between two or more layers of the flexible shoe body 102 such that an inner layer of the flexible shoe body 102 separates the dancer's foot from the heel member 400.

Figure 3B:
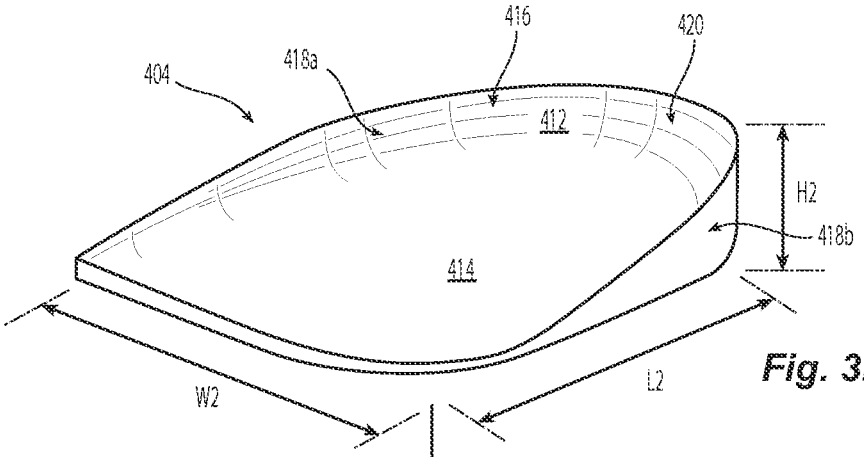
FIG. 3B is an isometric elevation view of the shock-absorbing member of the heel member shown in FIG. 3A configured in accordance with the present technology.
Figure 3C:
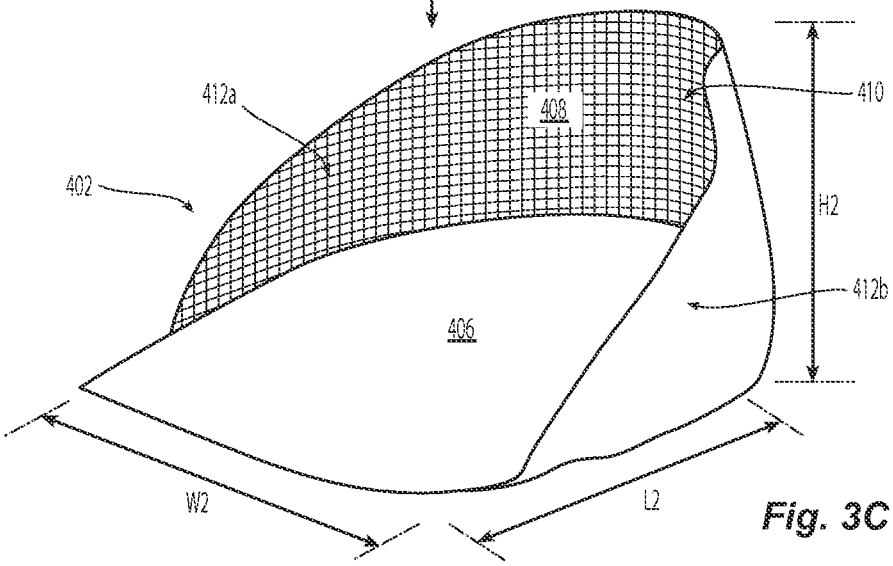
FIG. 3C is an isometric elevation view of the support member of the heel member shown in FIG. 3A configured in accordance with the present technology.

As shown in FIGS. 3B and 3C, the heel member 400 includes a shock-absorbing member 404 and a relatively stiff support member 402 configured to receive the shock-absorbing member 404. The shock-absorbing member 404 may be removable from the support member 402, or in some embodiments, the shock-absorbing member 404 may be fixedly attached to the support member 402 via stitching, adhesive, dip-coating, spray-on, molding, or other suitable fixation methods and/or devices.

The support member 402 has a bottom region 406 and a top region 408 extending upwardly from the periphery of the bottom region 406, as shown in FIG. 3C. The bottom region 406 of the support member 402 is generally flat and is configured to receive the shock-absorbing member 404. The top region 408 can have a rear wall 410 that provides rear support to the heel, and lateral walls 412*a* and 412*b* that provide lateral support and stability to the foot and/or ankle of the dancer. The support member 402 can be made from plastic, metal, fiberboard, or other suitable materials.

As best shown in FIG. 3B, the shock-absorbing member 404 has a bottom region 414 configured to receive (directly or indirectly) the bottom portion of the heel of the dancer's foot, and a heel wrap 416 having an inclined sidewall 415 that provides additional stability and support to the dancer's foot. In other embodiments, the shock-absorbing member 404 does not have a heel wrap 416. The heel wrap 416 of the shock-absorbing member 404 can linearly, exponentially or otherwise increase in height towards the periphery of the shock-absorbing member 404. The heel wrap 416 can have a rear wall 420 and lateral sidewalls 418*a* and 418*b* that provide additional support and/or stability to the dancer's foot. The shock-absorbing member 404 may be made from polyurethane, memory foam, foam, slow recovery foam, poron, Spenco "A," gels, and other suitable materials.

Different regions of the shock-absorbing member 404 can have different indentation force deflection ("IFD") values. IFD values correspond to the softness and/or firmness of the shock-absorbing member 404 and/or regions of the shock-absorbing member 404. The softer and/or less firm the region of the shock-absorbing member 404, the lower the IFD value. In some embodiments, the shock-absorbing member 404 can have increasing IFD values as the height H2 of the shock-absorbing member 404 decreases. In other words, a top portion of the shock-absorbing member is softer and/or less firm than a bottom portion of the shock-absorbing member 404. Additionally, in some embodiments the bottom region 414 of the shock-absorbing member 404 can be generally more firm (e.g., higher IFD values) than the heel wrap 416. That way, the heel wrap 416 provides additional cushioning and/or shock-absorption, while the bottom region 414 provides additional support and stability (but also provides additional cushioning and/or shock-absorption).

Figure 4A:
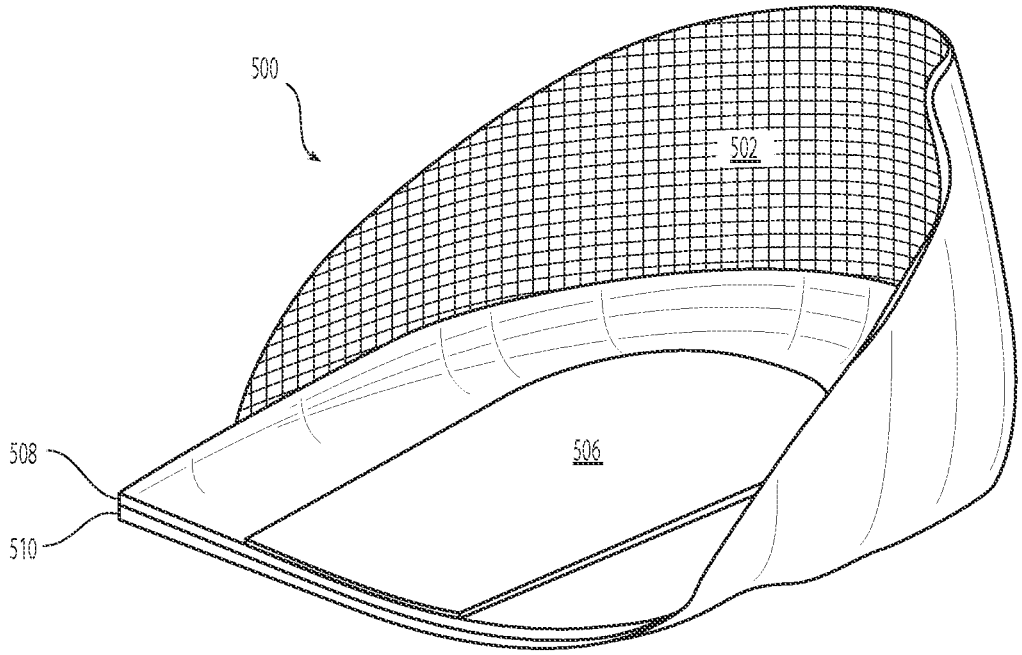
FIG. 4A is an isometric elevation view of another embodiment of a heel member configured in accordance with the present technology.
Figure 4B:
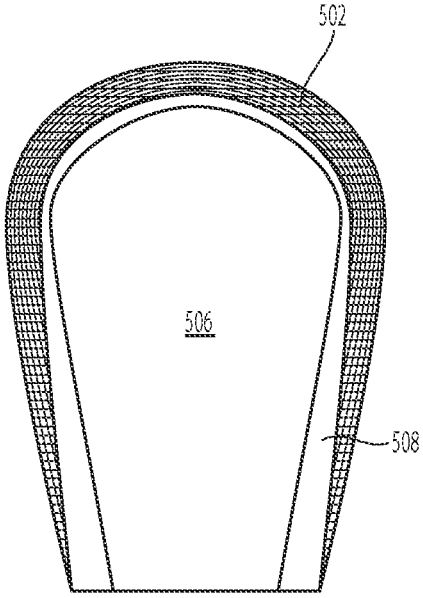
FIG. 4B is a top view of the heel member of FIG. 4A configured in accordance with the present technology.
Figure 4C:
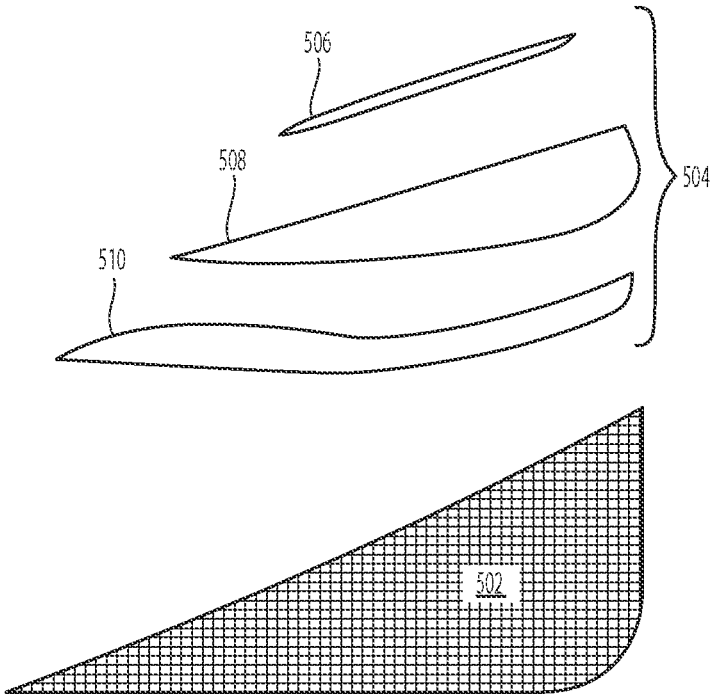
FIG. 4C is a schematic illustration of the layers comprising the heel member of FIG. 4A configured in accordance with the present technology.

FIGS. 4A and 4B are isometric and top views, respectively, of a heel member 500 having a support member 502 and a multi-layered shock-absorbing member 504. FIG. 4C is a break-out illustration of a side view of the heel member 500 shown in FIGS. 4A and 4B. Referring to FIGS. 4A-4C together, the shock-absorbing member 504 may comprise three adjacent layers: a top layer 506 having a top layer thickness TT and a top layer IFD value, an intermediate layer 508 having an intermediate layer thickness IT and an intermediate layer IFD value, and a bottom layer 510 having a bottom layer thickness BT and a bottom layer IFD value. In other embodiments, the shock-absorbing member 504 can have less than three layers (e.g., not layered, two layers, etc.) or more than three layers (e.g., four layers, five layers, etc.). As used herein, "thickness" refers to the thickness of the layer when not subject to external forces, such as the weight of the dancer.

In some embodiments, the layers may individually have different and/or the same IFD values so that a top portion of the shock-absorbing member 504 is softer and/or less firm than a bottom portion of the shock-absorbing member 504. For example, the top layer 506 can have a top layer IFD value that is less than an intermediate layer IFD value, and the intermediate layer IFD value can have a smaller IFD value than the bottom layer IFD value. In another embodiment, the top layer 506 can have a top layer IFD value that is the same as the intermediate layer IFD value, and the intermediate layer IFD value can have a smaller IFD value than the bottom layer IFD value. In particular embodiments, the top layer 506 can be made of memory foam, while the intermediate layer 508 and bottom layer 510 can be made of slow recovery foam of varying thicknesses.

In some embodiments, the layers may individually have different thicknesses. For example, the bottom layer thickness BT can be greater than the intermediate layer thickness IT, and the intermediate layer thickness IT can be greater than the top layer thickness TT. In some embodiments, the layers may individually have different widths and/or shapes. For example, as shown in FIGS. 4A and 4C, the intermediate layer 508 can be wider than the top layer 506 and also approximately the same width as the bottom layer 510.

The above-detailed embodiments of the disclosure are not intended to be exhaustive or to limit the disclosure to the precise form disclosed above. Specific embodiments of, and examples for, the disclosure are described above for illustrative purposes, but those skilled in the relevant art will recognize that various equivalent modifications are possible within the scope of the disclosure. For example, the dance shoe 100 of the present technology can include other dance shoes besides ballet shoes, such as a jazz dance shoe or a ballet boot. The various aspects of embodiments described herein can be combined and/or eliminated to provide further embodiments. Although advantages associated with certain embodiments of the disclosure have been described in the context of those embodiments, other embodiments may also exhibit such advantages. Additionally, not all embodiments need necessarily exhibit such advantages to fall within the scope of the disclosure.

Unless the context clearly requires otherwise, throughout the description and the claims, the words "comprise," "comprising," and the like are to be construed in an inclusive sense as opposed to an exclusive or exhaustive sense, i.e., in a sense of "including, but not limited to." Additionally, the words "herein," "above," "below," and words of similar import, when used in this application, shall refer to this application as a whole and not to any particular portions of this application. Use of the word "or" in reference to a list of items is intended to cover a) any of the items in the list, b) all of the items in the list, and c) any combination of the items in the list.

In general, the terms used in the following claims should not be construed to limit the invention to the specific embodiments disclosed in the specification unless the above-detailed description explicitly defines such terms. In addition, the inventors contemplate various aspects of the disclosure in any number of claim forms. Accordingly, the inventors reserve the right to add claims after filing the application to pursue such additional claim forms for other aspects of the disclosure.

I claim:

1. A ballet shoe configured to be worn by a wearer when the wearer is ballet dancing, the ballet shoe comprising:

a flexible shoe body including a forefoot portion, a heel portion opposite the forefoot portion, and a midfoot portion between the heel portion and the forefoot portion, wherein the shoe body includes a first layer and a second layer; and a front traction pad positioned at the forefoot portion of the flexible shoe body, wherein the front traction pad has a front section and a rear section;

a rear traction pad positioned at the heel portion of the flexible shoe body; and a metatarsal pad positioned at an interior portion of the forefoot portion of the flexible shoe body and aligned with at least one of the front section and the rear section;

an integrated heel member positioned at the heel portion of the flexible shoe body such that the heel member is sandwiched between the first layer and the second layer of the shoe body, the heel member including— a support member having— a bottom region;

a top region extending upwardly from the bottom region to a first height, wherein the top region has— a rear wall defining a rear portion of the support member; and lateral sidewalls extending forwardly the rear wall; and a shock-absorbing member positioned on the bottom region of the support member, the shock-absorbing member having a bottom portion and an inclined sidewall extending upwardly from a periphery of the bottom portion such that the inclined sidewall cups a wearer's heel when the wearer's foot is positioned in the dance shoe assembly, the inclined sidewall having a second height less than the first height, wherein the second height increases towards a periphery of the shock-absorbing member, wherein the shock-absorbing member includes— a first shock-absorbing layer;

a second shock-absorbing layer on the first shock-absorbing layer, wherein the second shock absorbing layer is softer than the first shock-absorbing layer; and a third shock-absorbing layer on the second shock-absorbing layer, wherein the third shock absorbing layer is softer than the second shock-absorbing layer, wherein the support member and shock-absorbing member are different components, and the shock-absorbing member is adhered to the bottom region of the support member, wherein, when the ballet shoe is being worn by the wearer, the ballet shoe conforms to the shape of the wearer's foot.

2. The ballet shoe of claim 1 wherein the shock-absorbing member is selected from the group consisting of polyurethane, memory foam, slow recovery foam, and one or more gels.

3. The ballet shoe of claim 1 wherein the shoe body is selected from the group consisting of canvas, leather, nylon, and cotton.

4. The ballet shoe of claim 1 wherein the shoe body is canvas.

5. The ballet shoe of claim 1 wherein the heel member is fixedly attached to the shoe body.

6. The ballet shoe of claim 1 wherein the support member is selected from the group consisting of plastic, metal, and fiberboard.

7. The ballet shoe of claim 1 wherein the shoe body is selected from the group consisting of canvas, leather, nylon, and cotton, and the support member is at least one of plastic, metal, and fiberboard.

* * * * *